United States Patent [19]

Off et al.

[11] 4,315,793

[45] Feb. 16, 1982

[54] APPARATUS FOR IMPLANTING POCKETS

[75] Inventors: Joseph W. A. Off, Irving; Judson H. Early, Dallas, both of Tex.

[73] Assignee: Haggar Company, Dallas, Tex.

[21] Appl. No.: 175,936

[22] Filed: Aug. 7, 1980

Related U.S. Application Data

[63] Continuation of Ser. No. 16,404, Mar. 1, 1979, abandoned.

[51] Int. Cl.[3] ..... B32B 31/00

[52] U.S. Cl. ..... 156/443; 156/513

[58] Field of Search ..... 156/443, 510, 513, 252, 156/253, 519, 521; 223/37; 2/247

[56] References Cited

U.S. PATENT DOCUMENTS

| | | | |
|---|---|---|---|
| 1,780,874 | 1/1930 | Friedman | 2/247 |
| 2,600,322 | 6/1952 | Raney | 156/519 |
| 2,922,167 | 4/1960 | Berlin | 2/243 |
| 3,335,682 | 8/1967 | Tucci | 112/2 |
| 3,765,992 | 10/1973 | Stageberg | 156/521 |
| 3,776,162 | 11/1973 | Scholl | 112/262 |
| 3,840,901 | 6/1974 | Eyster | 2/247 |
| 3,992,244 | 11/1976 | Craig et al. | 156/521 |
| 4,017,349 | 4/1977 | DePriest | 156/253 X |
| 4,096,020 | 6/1978 | Basu et al. | 156/519 |
| 4,226,661 | 10/1980 | Off et al. | 156/443 X |

*Primary Examiner*—David A. Simmons

*Attorney, Agent, or Firm*—Richards, Harris & Medlock

[57] ABSTRACT

An apparatus (10) for incorporating a pocket bag (30) into a garment panel (84) includes several operational stations (12, 14, 16, 18, 20, 22, 24). The pocket bag (30) and the garment panel (84) are held in place by a manually moveable template (44). The pocket bag (30) and garment panel (84) are adhesively interconnected at the first station (12). A slit (122) is formed at the second station (14). The edges of the slit (122) are folded back and secured to form a pocket slot (184) at the next two stations (16, 18). If desired, a welt (240) can be installed at another station (20). If desired, a facing strip (268) can be installed over the welt (240) and/or slot (184) at another station (22). The periphery of the closed pocket bag (30) is secured at the last station (24), after which the panel (84) can be assembled into a garment.

15 Claims, 22 Drawing Figures

APPARATUS FOR IMPLANTING POCKETS

This is a continuation of application Ser. No. 16,404 filed Mar. 1, 1979, abandoned.

TECHNICAL FIELD

The present invention relates in general to construction of garments and items of clothing. More particularly, this invention concerns an apparatus for implanting prefabricated pocket bags in garment panels.

BACKGROUND ART

In the manufacture of garments, pockets are provided as a convenient means for carrying useful items, such as a wallet, a handkerchief, currency, change, keys and the like. Pockets are integrated into the garment and take the general form of a pouch open at one end for easy access to the contents.

Two basic types of pockets are utilized in the garment industry; the patch type pocket and the standard type pocket. The patch pocket is formed simply by connecting a peripheral portion of a layer or patch of material directly to the outside surface of the garment. In contrast, the standard pocket opens onto the outside of the garment from an inside position, and gives the garment a less casual appearance.

The standard pocket, however, is of relatively more complex construction. In constructing such garment pockets, a pocket bag is manually integrated into a garment panel before assembly of the various panels into the garment. Material cutting, folding, positioning, sewing and trimming are some of the manual operations which have been required in constructing pockets. These manual operations are both time consuming and costly in terms of labor and material expenditure. The overall cost of a garment is affected to a significant degree by the pocket fabrication operation.

In an attempt to solve some of these problems and thus reduce the overall cost of a garment, some efforts have been directed to reduction of manufacturing steps through elimination or combination. For example, in co-pending application Ser. No. 905,054, now U.S. Pat. No. 4,156,293, and co-pending application Ser. No. 948,016, now U.S. Pat No. 4,263,678, both assigned to the assignee hereof, there are shown inventions relating to the manual construction of individual pockets with the aid of adhesives. In another co-pending application assigned to the assignee hereof, application Ser. No. 971,022, filed Dec. 19, 1978, now U.S. Pat. No. 4,226,661, there is shown a device which uses fabric and adhesive materials to prefabricate pocket bags ready for subsequent incorporation into the garment. Heretofor, however, there has not been available an apparatus which operates on a semi-automatic basis to implant preformed pocket bags into garment panels.

The present invention comprises an apparatus for implanting pockets which overcomes the foregoing and other difficulties associated with the prior art. According to the invention, there is provided an apparatus for implanting preformed pocket bags into garment panels on a semi-automatic basis. The apparatus herein is particularly suited for use with the device shown in co-pending application Ser. No. 971,022, now U.S. Pat. No. 4,226,661, and the prefabricated pocket bags formed thereby. The invention comprises a series of stations which perform several operations on a garment panel and prefabricated pocket bag to integrate or implant the bag into the panel and thus form a pocket. Garment panels having pockets are thus produced on a semi-automatic basis for subsequent assembly into complete garments. Use of the invention eliminates many of the manual steps which have characterized the pocket construction aspect of garment fabrication heretofor. The present invention results in improved efficiency in the overall production of garments.

More specifically, the present invention comprises a series of stations for performing sequential operations to a garment panel and prefabricated pocket bag clamped within a releasable template. No particular preparation of the garment panel is required beforehand. The stations are preferably interconnected by a flat surface with a guide thereon to facilitate movement of the template between stations. A pair of locating pins are preferably provided at each station to secure the template in proper position. At the first station, the panel and pocket bag are adhesively interconnected. At the second station, a predetermined slit is formed through the panel and pocket bag. A pocket slot is formed at the third and fourth stations. At the fifth station, a pocket welt can be provided across the pocket slot, if desired. A facing strip is attached at the sixth station. Reinforcing stitching through the pocket bag and garment panel can then be added, if desired, before closing and adhesively sealing the pocket bag in the last station to complete implantation of the pocket.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 1:
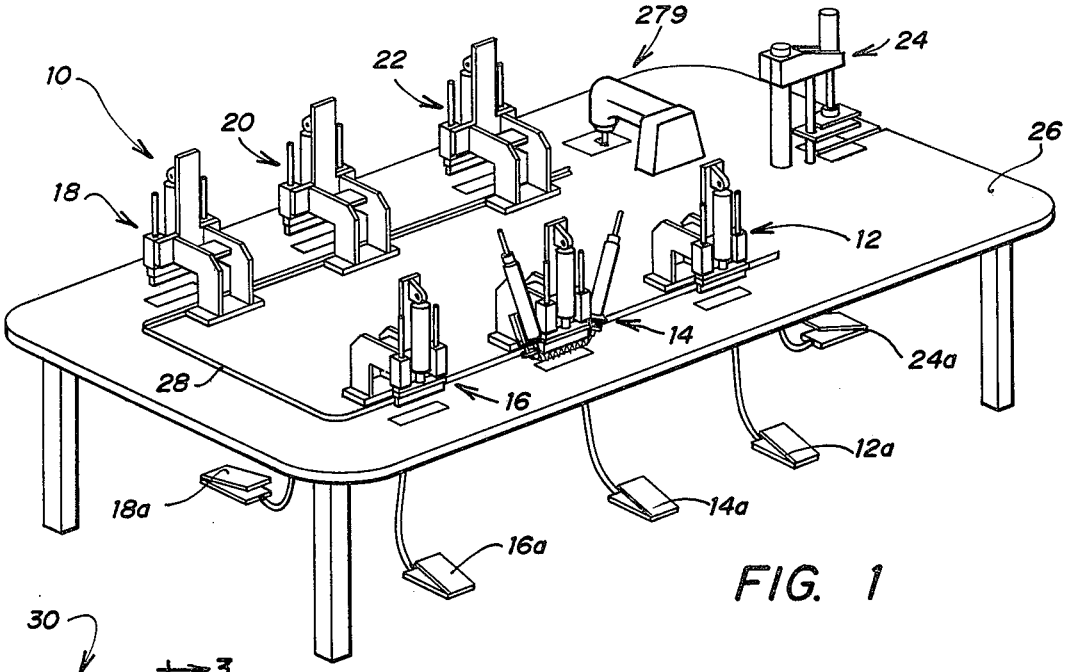
FIG. 1 is a perspective illustration of an apparatus for implanting pockets incorporating the invention.

Referring now to the Drawings, wherein like reference numerals designate like or corresponding parts throughout the several views, and particularly referring to FIG. 1, there is shown an apparatus for implanting pockets 10 incorporating the invention. In the preferred embodiment of the invention, the apparatus 10 is comprised of seven stations; stations 12, 14, 16, 18, 20, 22 and 24. The stations 12–24 are mounted in spaced relationship near the periphery of a table 26. A guide member 28 on the surface of table 26 extends between the stations 12–24. As will be more fully described hereinafter, a template is manually sequenced through the stations 12–24 to integrate a prefabricated pocket bag into a precut garment panel, and thereby eliminate many of the time consuming manual operations which have heretofor characterized construction of pockets in garments.

Each of the stations 12–24 is provided with a corresponding foot switch, such as foot switch **12*a* in station 12, for selective operation of the station. If desired, hand switches instead of foot switches can be utilized in the apparatus 10**.

Figure 2:
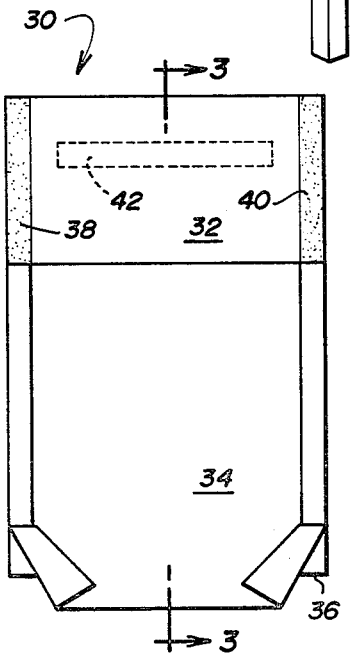
FIG. 2 is a plan view of a pocket bag useful in practicing the invention.
Figure 3:
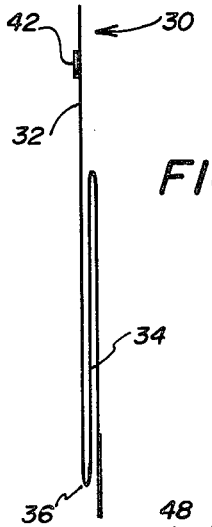
FIG. 3 is a sectional view taken along lines 3—3 of FIG. 2 in the direction of the arrows.

Referring to FIGS. 2 and 3, there is shown a pocket bag 30 which is useful in practicing the invention. The pocket bag 30 is preferably of the type described in application Ser. No. 905,054, now U.S. Pat. No. 4,156,293, and application Ser. No. 948,016, now U.S. Pat. No. 4,263,678, the disclosures of which are hereby incorporated by reference.

Briefly, the pocket bag 30 comprises a pocket blank formed into inner and outer pocket panels 32 and 34, respectively, interconnected by a bottom fold 36. Adhesive strips 38 and 40 are attached along the longitudinal edges of the pocket bag 30. Preferably, a transverse adhesive strip 42 is attached on the reverse side of pocket panel 32. Although the apparatus 10 is particularly adapted for use with pocket bags prefabricated with adhesives, it will be understood that the invention can also be used with other suitable types of pocket bags.

As used herein, the term "adhesive" means nylon, polyamide, polyester, or other fusible substances convertible from one state to another responsive to the application of appropriate forms of energy in order to effect a bond or adhesive connection. Adhesive materials suitable for use in the invention can be of the type manufactured by General Fabric Fusing Company of Cincinnati, Ohio, for example.

Figure 4:
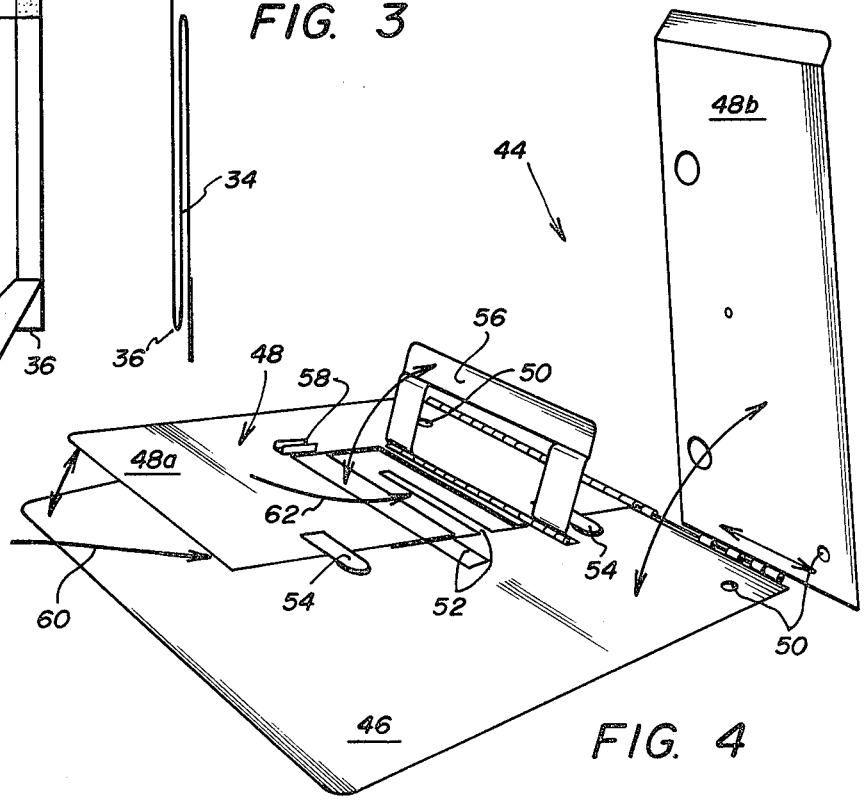
FIG. 4 is a perspective illustration of a template useful in practicing the invention.

Referring to FIG. 4, there is shown a portable template 44 which is manually sequenced through the stations 12–24 of the apparatus 10. The template 44 is utilized to hold a precut garment panel and a prefabricated pocket, such as pocket bag 30, in proper relationship. The template 44 comprises a lower plate 46 and an upper plate 48 hinged together at the top. Holes 50 are provided through the upper corners of plates 46 and 48 for receiving locating pins at each of the stations 12–24. A slot 52 is provided in each plate 46 and 48. The upper plate 48 is divided into two sections **48*a* and 48*b*. The right upper plate section 48*b* is slidable between an open position, shown in full lines in FIG. 4, and a closed position under tabs 54 attached to the left section 48*a*. A window plate 56 is hinged to the upper plate 48 and surrounds the slot 52. A latch 58 is provided on each section of the upper plate 48 for fastening down the window plate 56**.

In using the apparatus 10, the template 44 is first loaded. Plates 46 and 48 are opened to receive a precut garment panel as indicated by arrow 60 in FIG. 4. It will be understood that any type of precut garment panel can be utilized, and that no special preparation thereof is necessary. For example, a trouser panel can be inserted between plates 46 and 48 and thus over slots 52 therein.

Plates 46 and 48 are then closed upon the garment panel, and a strip of adhesive (not shown) is positioned on the garment panel within slots 52. The adhesive strip can be loaded manually, initially attached to the garment panel, or initially attached to pocket bag as strip 42 shown in FIG. 2. Pocket bag 30 is then inserted between plate 48 and window 56 as indicated by arrow 62 in FIG. 4. The window plate 56 is then closed and latched to secure the pocket bag 30 in place. It will thus be understood that template 44 serves the purpose of holding a garment panel, pocket bag and intermediate strip of adhesive in proper fixed relationship for advancement through the stations of apparatus 10.

Figure 5:
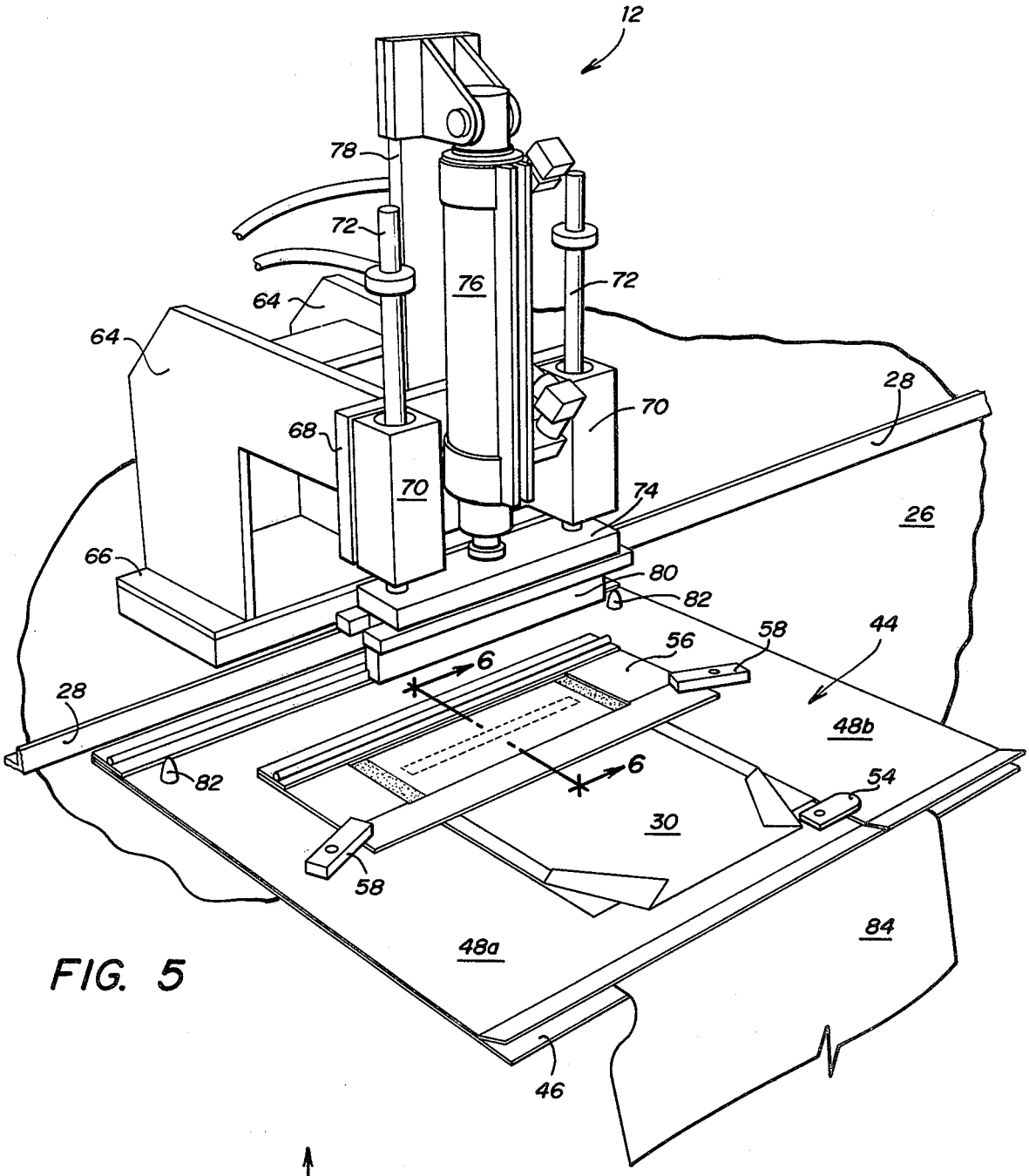
FIG. 5 is a perspective illustration of the first station in the invention.
Figure 6:
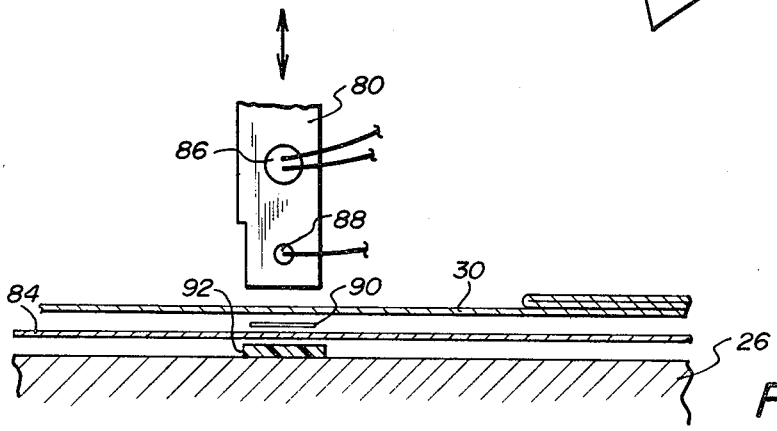
FIG. 6 is a sectional view taken along line 6—6 of FIG. 5 in the direction of the arrows.

Referring to FIGS. 5 and 6, there are shown the constructional details of the first station 12. Station 12 includes a pair of spaced apart uprights 64 attached to the table 26. The uprights 64 are L-shaped and are secured to a base 66 mounted behind the guide member 28. A crossplate 68 is secured to the other ends of uprights 64. Two guides 70 are attached to the crossplate 68, and a rod 72 is received through each guide. A cross member 74 is attached to the ends of rods 72 beneath guides 70. A double-acting cylinder 76 is connected between a post 78 attached to the fixed crossplate 68, and the cross member 74. Cylinder 76 is preferably pneumatic. An elongate bar 80 is mounted across the bottom of the cross member 74. It will thus be understood that the cylinder 76 is operable to reciprocate bar 80 relative to the table 26. Actuation of the cylinder 76 is effected by means of a suitable control, such as foot switch **12*a* shown in FIG. 1**.

The template 44 is manually advanced along guide member 28 to a position beneath the bar 80 of station 12. Two locating pins 82 engage the template 44 for proper positioning relative to the bar 80. The locating pins 82 can be either fixed or retractable. FIG. 5 shows the template 44, loaded with pocket bag 30 and garment panel 84, properly positioned in station 12. In FIG. 6, plates 46, 48 and 56 of template 44 have been omitted for clarity.

The bar 80 is then reciprocated to adhesively interconnect pocket bag 30 and panel 84. In the preferred embodiment of the invention, the bar 80 is heated by means of an internal electrical resistance element 86, which is best shown in FIG. 6. Preferably, a thermocouple or thermistor 88 is also mounted in the bar 80 for monitoring and controlling the temperature thereof. The temperature of bar 80 is thus maintained at a level sufficient to activate a strip of adhesive 90 disposed between pocket bag 30 and garment panel 84. The adhesive strip 90 can be initially attached to the garment panel 84 before loading into the template 44, but is preferably attached to the pocket bag 30 as the transverse strip 42 shown in FIG. 2. In addition, it will be apparent that the bar 80 could include an ultrasonic or radio frequency source, instead of electrical resistance element 86. Alternatively, an external source of radiation or heat could be utilized to activate adhesive strip 90.

The bar 80 is thus operable to engage pocket bag 30, adhesive strip 90 and garment panel 84 against an underlying block 92 attached to the table 26. Block 92 preferably comprises a non-stick material, such as TEFLON. Preferably, a conventional timer is connected to the control for cylinder 76 so that the duration of engagement is sufficient to activate adhesive strip 90. The pocket bag 30 and garment panel 84 are thus adhesively interconnected at station 12, after which the template 44 is disengaged from locating pins 82 for manual advancement to station 14.

Figure 7:
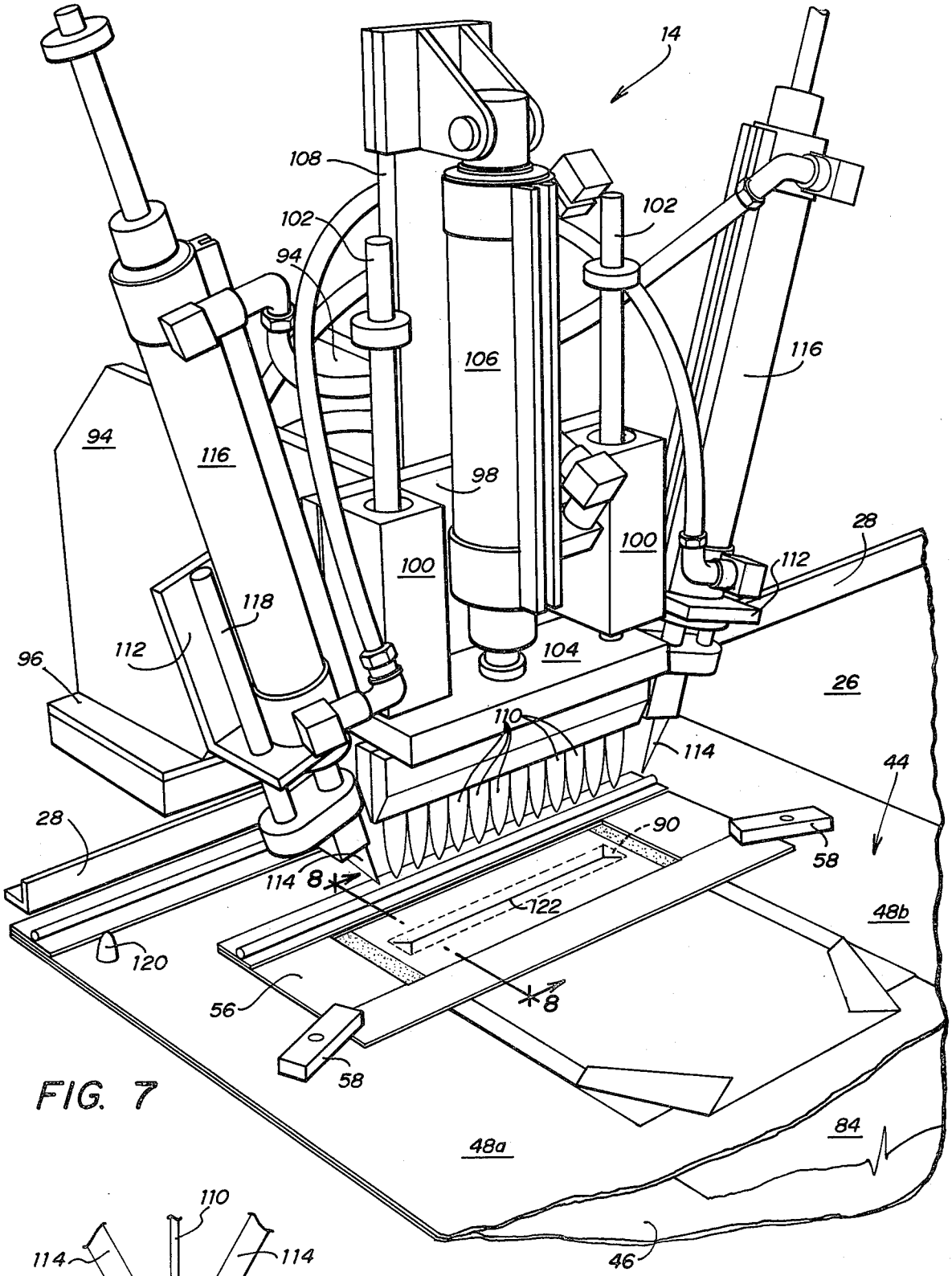
FIG. 7 is a perspective illustration of the second station in the invention.

Referring to FIG. 7, there are shown the constructional details of station 14. Station 14 includes a pair of spaced apart uprights 94 attached to the table 26. Uprights 94 are L-shaped and secured to a base 96 mounted behind the guide member 28. A crossplate 98 is secured across the ends of uprights 94. Guides 100 are attached to the crossplate 98 in spaced relationship, and a rod 102 is slidably received by each guide. Beneath guides 100 a cross member 104 is secured to the ends of rods 102. A double-acting cylinder 106 is connected between cross member 104 and a post 108 extending upwardly from crossplate 98. The cylinder 106 is preferably of the pneumatic type. Several blades 110 mounted in a straight row extend from the underside of cross member 104. The blades 110 are preferably removably secured to cross member 104 for ease of replacement. The cylinder 106 is thus operable to reciprocate blades 110 relative to the table 26.

Brackets 112 are also attached to the crossplate 98 at positions outboard of guides 100. A pair of blades 114, only one of which is shown in FIG. 7, are connected to the piston rod of a double-acting cylinder 116 connected to each bracket 112. The cylinders 116 are preferably pneumatic. Guide rods 118, only one of which is shown, extend from the attachments for blades 114 and are slidably received by brackets 112. Cylinders 116 are thus operable to reciprocate blades 114 relative to the table 26.

Operation of cylinders 106 and 116 is effected through a suitable control, such as foot switch **14*a* shown in FIG. 1**. If desired, a programmer could be used instead for multiple cutting and sequencing operations.

Figure 8:
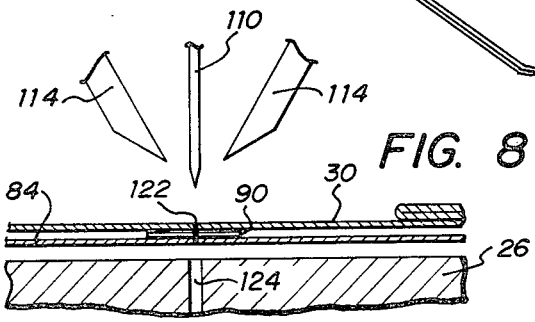
FIG. 8 is a cross-sectional view taken along line 8—8 of FIG. 7 in the direction of the arrows.

Referring to FIG. 8 in conjunction with FIG. 7, the template 44 is manually advanced to station 14. Plates 46, 48 and 56 of template 44 have been omitted from FIG. 8 for clarity. Template 44 is positioned upon engagement with locating pins 120, only one of which is shown. The locating pins 120 can be either fixed or retractable. Blades 110 and 114 are then reciprocated by cylinders 106 and 116, respectively, to form a slit 122 through pocket bag 30 and garment panel 84 in the area of the adhesive connection therebetween. A corresponding slot 124 is provided in the table 26 as shown in FIG. 8 to accommodate downward movement of blades 110 and 114. In the preferred embodiment of the invention, blades 110 are extended first and blades 114 are extended thereafter. Station 14 thus serves to form a predetermined slit through pocket bag 30 and garment panel 84. After provision of the slit, template 44 is disengaged and manually advanced to station 16.

Figure 9:
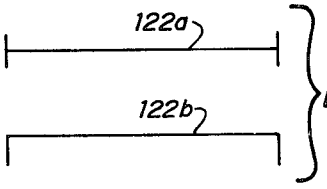
FIG. 9 is an illustration of alternative slit configurations.

The preferred configuration of slit 122 is shown in FIG. 7. Blades 110 form the central portion of slit 122, while blades 114 form the end portions of the slit. The preferred configuration of slit 122 (and slot 124) is thus a straight middle portion with Y-shaped end portions. It will be understood, however, that at least two other slit configurations can be formed simply by rearranging blades 114. In FIG. 9, slit **122*a* includes T-shaped end portions and slit 122*b* includes L-shaped end portions. Any one of these alternative slit configurations can be provided by the structure of station 14**.

Figure 10:
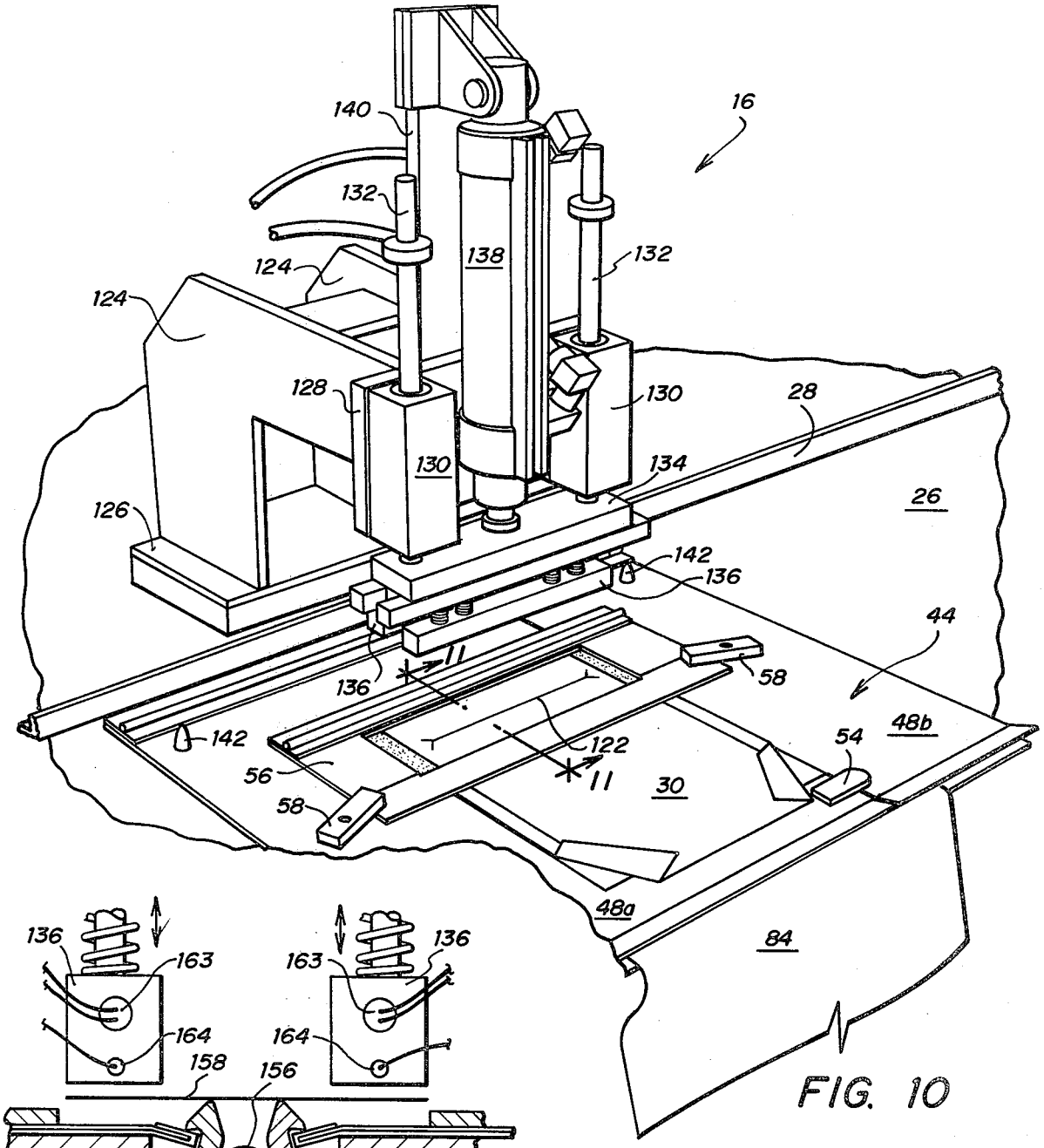
FIG. 10 is a perspective illustration of the third station in the invention.

Referring to FIG. 10, there are shown the constructional details of station 16 in apparatus 10. Station 16 includes a pair of spaced apart uprights secured to table 26. The uprights 124 are L-shaped and are attached to a base 126 mounted behind the guide member 28. A crossplate 128 is secured across the ends of uprights 124. Attached to the crossplate 128 are two guides 130, each slidably receiving a rod 132. A cross member 134 is secured across the ends of rods 132 beneath guides 130. Two elongated bars 136 are supported in parallel fashion from the cross member 134. A double acting cylinder 138 is coupled between the cross member 134 and a post extending upwardly from the crossplate 128. The cylinder 138 is preferably of the pneumatic type. Cylinder 138 is thus operable to reciprocate bars 136 relative to table 26.

Operation of cylinder 138 is effected by means of a suitable control, such as foot switch **16*a* shown in FIG. 1. Preferably, a conventional timer is connected to the control for cylinder 138** so that the duration of engagement is sufficient to activate preselected adhesive areas.

The template 44 is positioned in station 16 by means of locating pins 142, which can be either fixed or retractable.

Figure 11:
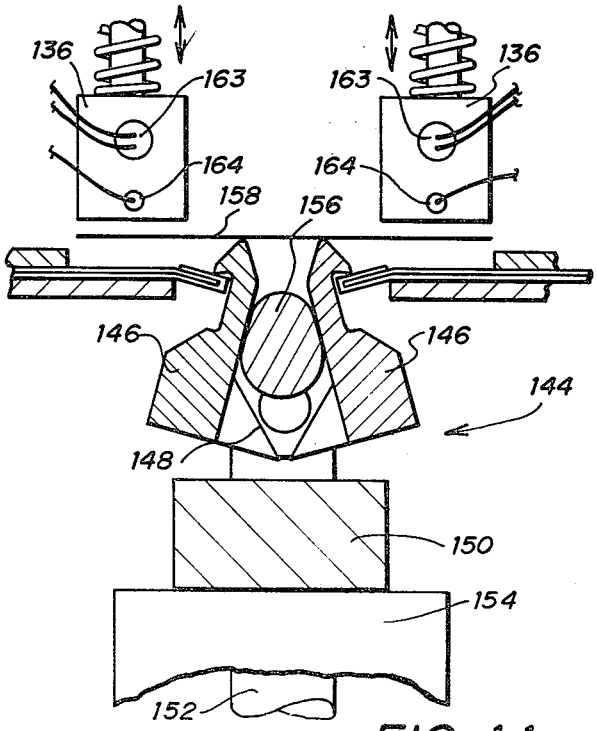
FIG. 11 is a cross-sectional view taken along line 11—11 of FIG. 10.

FIG. 11 further illustrates constructional details of station 16. Plates 46, 48 and 56 of template 44 have been omitted from FIG. 11 for clarity. An edge folder assembly 144 is disposed within a slot provided in table 26. Assembly 144 includes two longitudinal clamp bars 146 which are mounted for pivotal movement about a common axis 148. The clamp bars 146 are pivotally supported at both ends by pins (not shown) through pairs of ears extending from both the bars and a base 150. A pair of spaced apart rods 152, only one of which is shown, extend downwardly from base 150 and are slidably received in a frame. The base 150 and clamp bar 146 are thus mounted for vertical movement.

A cylinder assembly 154 is also secured to the base 150. In the preferred construction of folder assembly 144, cylinder assembly 154 comprises two independent double-acting cylinders connected in end-to-end relationship. The cylinders of cylinder assembly 154 are preferbly pneumatic. The piston rod of the lower section of cylinder assembly 154 is coupled to underlying frame structure, while the piston rod of the upper section of the assembly extends through an opening in the base 150 and is coupled to a cam member 156 slidably disposed between the clamp bars 146. It will be apparent that vertical movement of the cam member 156 causes pivoting of the clamp bars 146.

The cylinder assembly 154 thus articulates the clamp bars 146 in two manners. The clamp bars 146 are first raised through the slit 122 formed into the pocket bag 30 and garment panel 84. The clamp bars 146 are next pivoted outwardly to fold back the longitudinal edges of the slit as shown in FIG. 11. Only the middle portion of slit 122 is folded back by bars 146.

Figure 12:
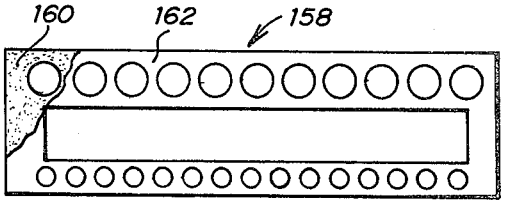
FIG. 12 is an illustration of an adhesive strip useful in practicing the invention.

The long edges of the slit 122 are then adhesively secured in the folded back positions. At least one adhesive strip is manually positioned over the folded edges before actuation of bars 136. Separate strips of adhesive or one adhesive strip 158 having a cutout therein can be utilized. A preferred form of the adhesive strip 158 is shown in FIG. 12. Adhesive strip 158 preferably comprises a layer of adhesive 160 on a removable backing 162. If desired, the adhesive strip 158 can be perforated as shown to reduce stiffness about the pocket slots to be formed.

After positioning, the adhesive strip 158 is applied to the pocket bag 30 through engagement by bars 136. In the preferred construction, each bar 136 is heated by means of an internal electrical resistance element 163. A thermocouple or thermistor 164 is also mounted in each bar 136 for monitoring and controlling the temperature thereof. If desired, each bar 136 could be provided with an ultrasonic or radio frequency source. Alternatively, an external source of radiation or heat could be utilized to activate the adhesive. The bars 136 are preferably yieldably supported from the cross member 134 as shown. The station 16 thus serves to form a partial pocket slot through the pocket bag 30 and garment panel 84 by folding back and securing the long edges of slit 122. After completion of this operation, template 44 is disengaged and manually advanced to station 18.

Figure 13:
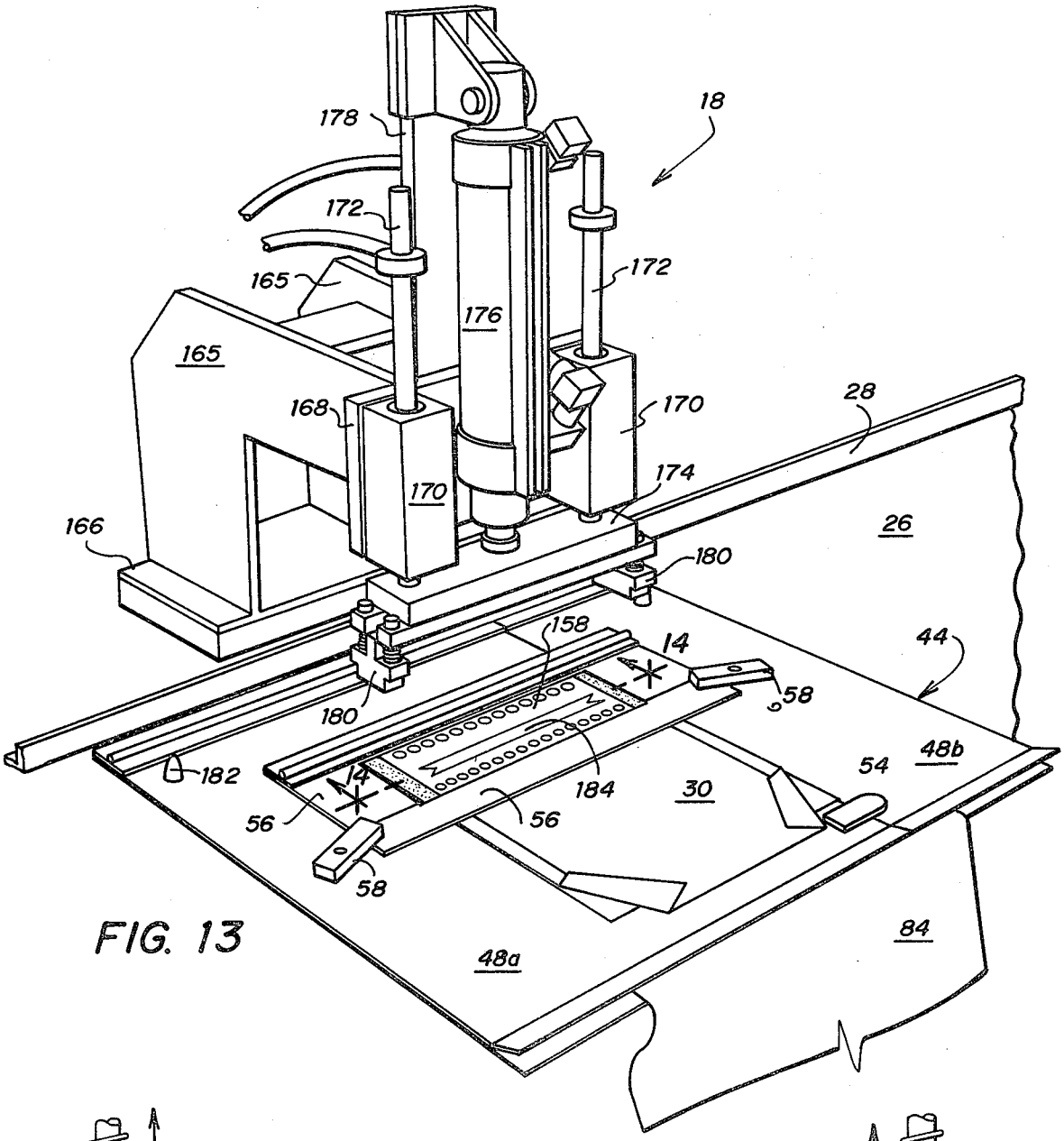
FIG. 13 is a perspective illustration of the fourth station in the invention.

Referring to FIG. 13, there are shown the constructional details of station 18. Station 18 includes a pair of spaced apart, L-shaped uprights 165 anchored to a base 166 mounted behind guide member 28 on table 26. A crossplate 168 extends between the ends of uprights 165. A pair of guides 170 are mounted on crossplate 168 and slideably receive rods 172. A cross member 174 is secured across the ends of rods 172. A double-acting cylinder 176 is coupled between cross member 174 and a post 178 attached to the crossplate 168. Cylinder 176 is preferably pneumatic. A transverse bar 180 is supported at each end of the cross member 174. A pair of positioning pins 182, only one of which is shown, is provided for engagement with the template 44. Cylinder 176 is thus operable to reciprocate bars 180 relative to template 44.

FIG. 13 illustrates the template 44 as initially received and positioned in station 18. The folded back long edges of the partially formed pocket slot 184 are beneath the adhesive strip 153. The purpose of station 18 is to fold back and secure the remaining slit edges to complete formation of pocket slot 184.

Figure 14:
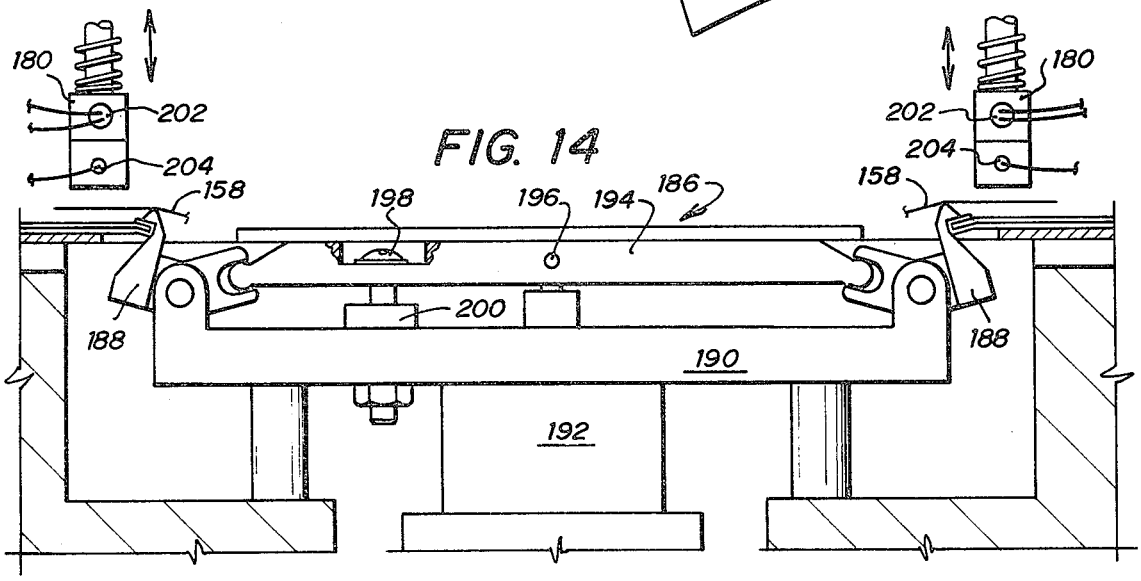
FIG. 14 is a cross-sectional view taken along line 14—14 of FIG. 13 in the direction of the arrows.

FIG. 14 illustrates additional constructional features of station 18. Plates 46, 48 and 56 of template 44 have been omitted from FIG. 14 for clarity. An edge folder assembly 186 is positioned within an opening in table 26. Assembly 186 includes a pair of clamp fingers 188 pivotally supported at the ends of a bar 190. The bar 198 is supported by a cylinder assembly 192 similar to cylinder assembly 154 described with regard to station 16. The assembly 192 comprises two independent double-acting cylinders mounted in end-to-end relationship. The piston rod of the lower cylinder is coupled to underlying support structure, while the piston rod of the upper cylinder extends through an opening in bar 190 and is coupled to arm 194 by means of a pin 196 so that the arm can float. The ends of arm 194 are rounded as shown, and are received by slots provided in the clamp fingers 188.

Vertical movement of arm 194 thus effects pivotal movement of fingers 188. A screw 198 and spacer 200 are connected between the bar 190 and arm 194 to limit relative movement of the arm.

When the template 44 arrives at station 18, it will be apparent that only preselected portions of adhesive strip 158 have been activated. Those activated portions comprise areas extending parallel to the pocket slot 184. The opposite ends of the adhesive strip 158 at this point are thus unattached.

Upon positioning of template 44, folder assembly 186 is actuated. The clamp fingers 188 are first raised through pocket slot 184 and then pivoted outwardly by cylinder assembly 192 to fold the tabs at the ends of the slot backward and underneath adhesive strip 158. Bars 180 are then reciprocated to adhesively secure the folded ends of slit 122. In the preferred construction, each bar 180 is heated by means of electrical resistance element 202. Each bar 180 also includes a thermocouple or thermistor 204 for monitoring and controlling the temperature thereof. Each bar 180 is also preferably yieldably supported from cross member 174 as shown. If desired, each bar 180 could include an ultrasonic or radio frequency source, or an external source of radiation or heat could be utilized to activate the adhesive. Station 18 thus serves to complete formation of the pocket slot 184 by folding back and adhesively securing the ends of the slit formed in station 14. After completion of the pocket slot 184, template 44 is disengaged and manually advanced to station 20.

Upon leaving station 18, the backing 162 on adhesive strip 158 is peeled away to expose the upper surface of the adhesive.

The construction and operation of stations 16 and 18 comprise a significant feature of this invention. The formation of pocket slot 184 is accomplished in two steps. A station 16, the longitudinal edges of slit 122 are folded back and adhesively secured. At station 18, the ends of slit 122 are folded back and adhesively secured with a different portion of adhesive strip 158 applied previously. The pocket slot 184 is thus formed through the pocket bag 30 and garment panel 84 simultaneously by slashing, folding and adhesive interconnection steps with little manual intervention.

Figure 15:
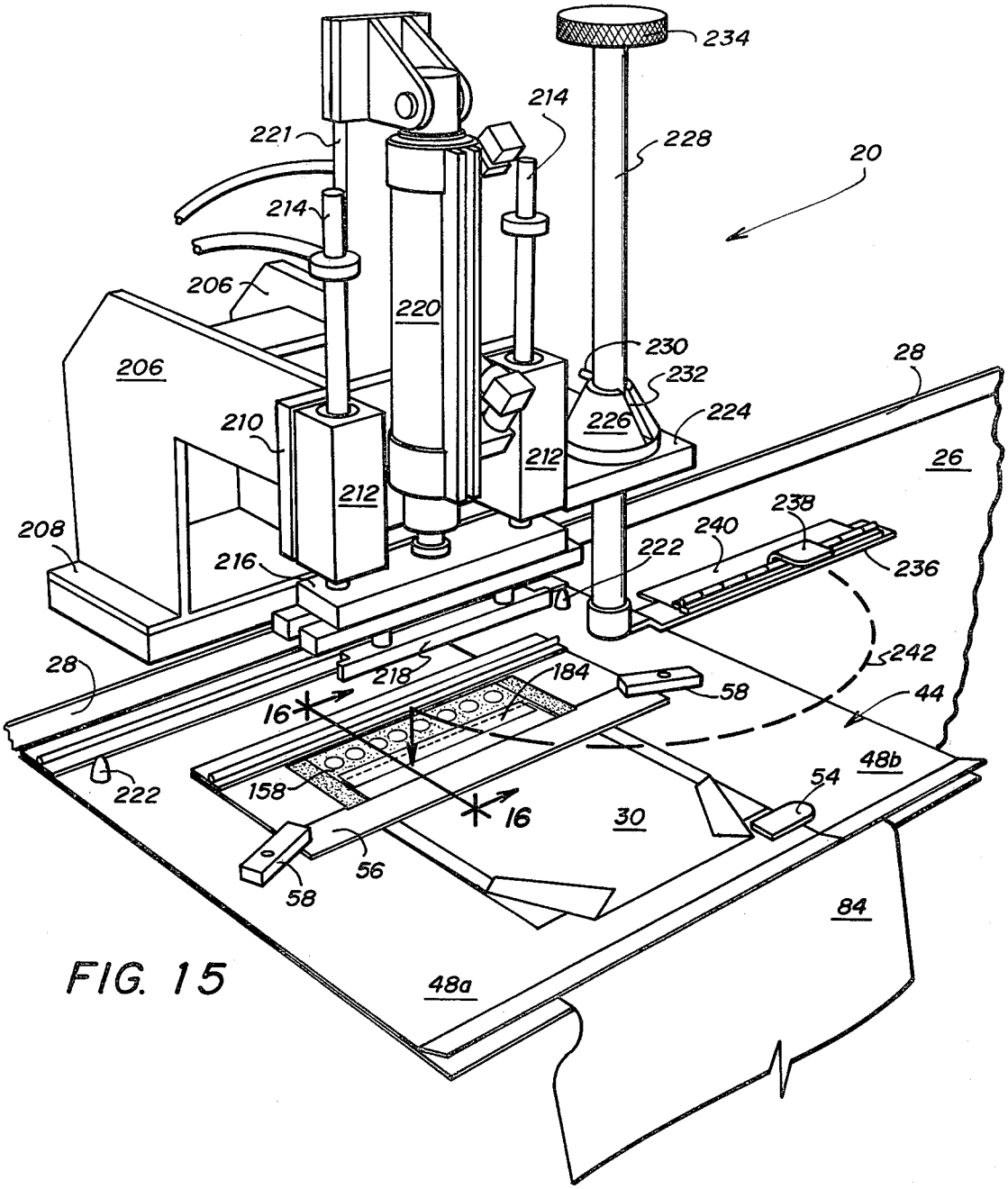
FIG. 15 is a perspective illustration of the fifth station in the invention.

Referring to FIG. 15, there are shown the constructional details of station 20 in apparatus 10. Station 20 is utilized when it is desired to construct a pocket having a welt therein. It will be understood that use of station 20 is optional.

Station 20 includes a pair of spaced apart, L-shaped uprights 206 attached to a base 208 mounted behind the guide member 28 on table 26. A crossplate 210 is secured across the ends of uprights 206. A pair of guides 212 are mounted on the crossplate, and each guide slideably receives a rod 214 therethrough. A cross member 216 is secured between the ends of rods 214 beneath guides 212. A bar 218 is supported from the cross member 216. A double-acting cylinder 220 is connected between cross member 216 and a post 221 attached to the crossplate 210. The cylinder 220 is preferably pneumatic. A pair of locating pins 222 are provided at station 20 for engaging the template 44. Pins 222 can be either fixed or retractable. The cylinder 220 is thus operable to reciprocate bar 218 relative to template 44.

Station 220 also includes a bracket 224 attached to the crossplate 210. Mounted on bracket 224 is a collar 226, through which a rod 228 slideably extends. A pin 230 is attached to rod 228, and a vertical slot 232 is provided in collar 226. A knob 234 is attached to the top end of rod 228, while a foot 236 extends outwardly from the bottom end thereof. The foot 236 includes a releaseable clip 238 for receiving a pocket welt 240 thereunder. Rotation of knob 234 thus causes foot 236 to turn and drop into position adjacent to template 44 when pin 230 meets slot 232. The path of foot 236 is indicated by dashed line 242. The welt 240 is thus positioned immediately above and along the pocket slot 184 as shown in phantom lines in FIG. 15. Of course, welt 240 could be manually positioned, if desired.

Figure 16:
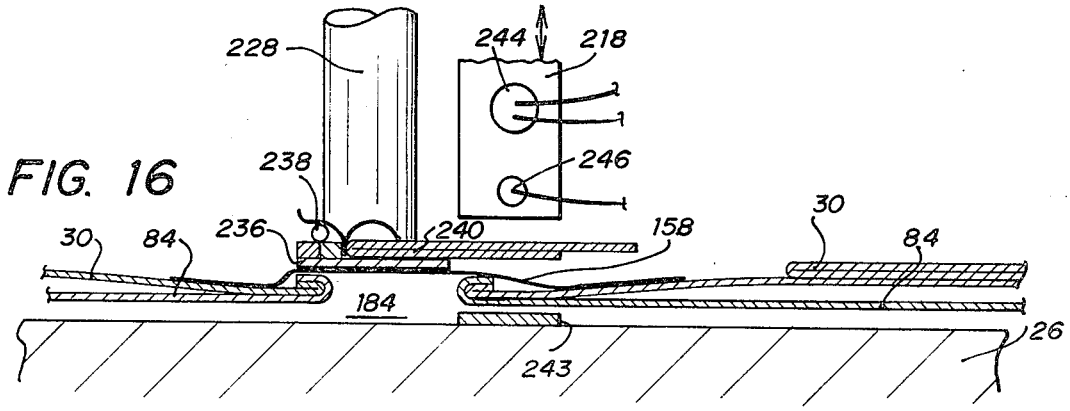
FIG. 16 is a cross-sectional view taken along line 16—16 of FIG. 15 in the direction of the arrows.

FIG. 16 shows further details of station 20. Plates 46, 48 and 56 of template 44 have been omitted from FIG. 16 for clarity. The welt 240 is positioned between bar 218 and an inside surface of the pocket bag 30. An anvil block 243 is secured to table 26 beneath bar 218. Block 243 preferably comprises a non-stick material, such as TEFLON. In the preferred construction of the invention, bar 218 is heated by an internal electrical resistance element 244. A thermocouple or thermister 246 is attached to bar 218 to monitor and control the temperature thereof. In the alternative, bar 218 could include an ultrasonic or a radio frequency source, or an external source of radiation or heat could be utilized for activating the adhesive. Actuation of cylinder 220 causes bar 218 to engage the pocket welt 240 and thus adhesively connect the welt along the pocket slot 184. After retraction of bar 218, clip 238 is released and the template 44 is manually disengaged and advanced to station 22.

Figure 17:
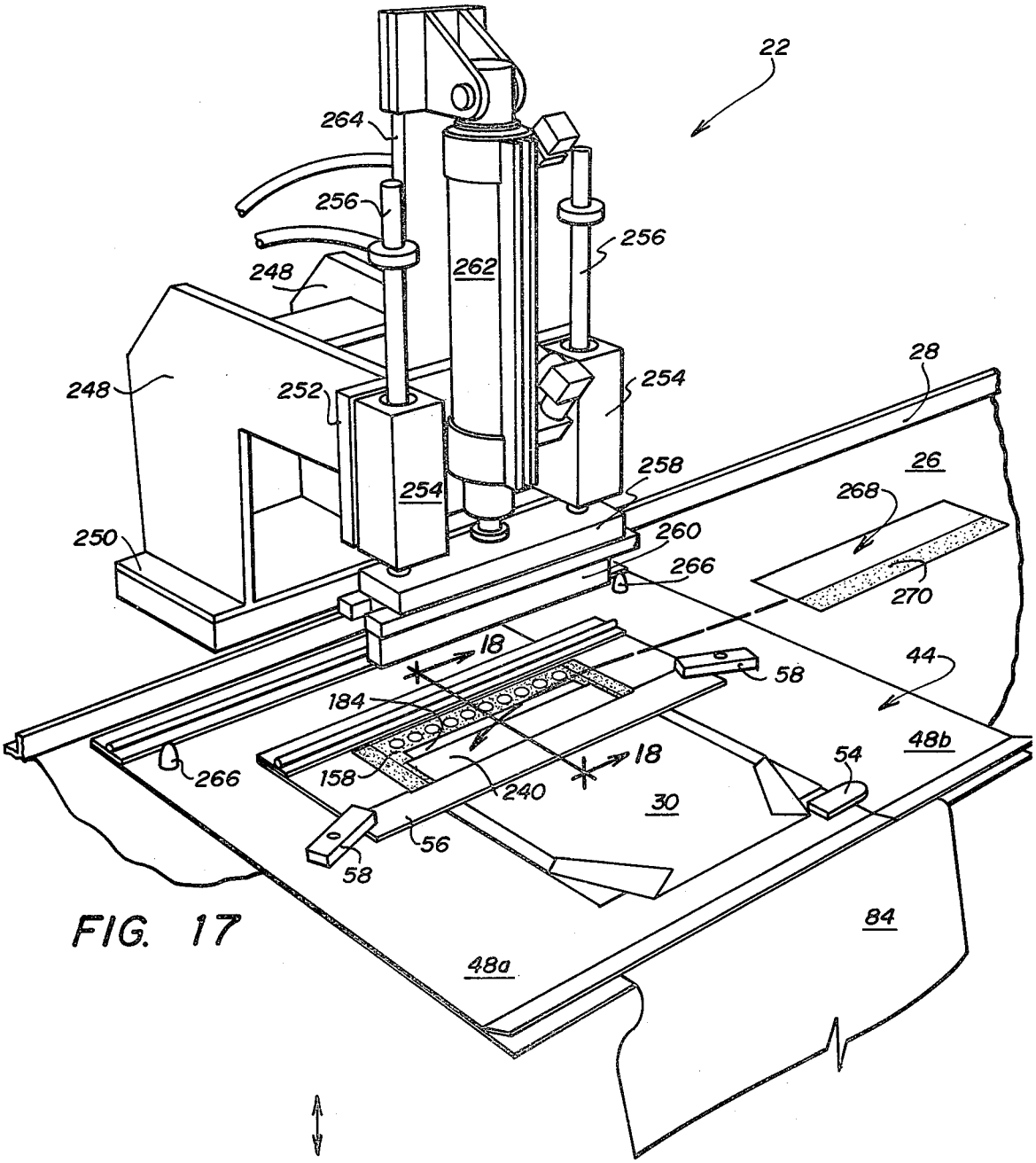
FIG. 17 is a perspective illustration of the sixth station in the invention.

The constructional details of station 22 can be seen in FIG. 17. A facing strip is added to the pocket construction at station 22. The template 44 can be advanced to station 22 directly from station 18 if a pocket construction without a welt is desired. For purposes of illustration, however, template 44 is shown in FIG. 17 with the welt 240, which was applied at station 20.

Station 22 includes a pair of spaced apart uprights 248 secured to a base 250 mounted behind guide member 28 on table 26. A crossplate 252 is secured across the ends of the L-shaped uprights 248. Mounted on the crossplate 252 are a pair of guides 254, each of which slideably receives a rod 256. A cross member 258 is secured between the rods 256 beneath guides 254. A bar 260 is supported from the cross member 258. A double-acting cylinder 262 is coupled between cross member 258 and a post 264 attached to the crossplate 252. Cylinder 262 is preferably pneumatic. A pair of locating pins are provided for engagement with template 44. Pins 266 can be either fixed or retractable. Cylinder 266 is thus operable to reciprocate head 260 relative to template 44.

A facing strip 268 is applied at station 22. Facing strip 268 comprises a rectangular strip of fabric material. In accordance with the preferred construction, strip 268 includes an adhesive strip 270 attached along the lower edge on one side thereof as shown. The facing strip 268 is manually positioned within window plate 56 and over welt 240 and the remainder of pocket slot 184.

Figure 18:
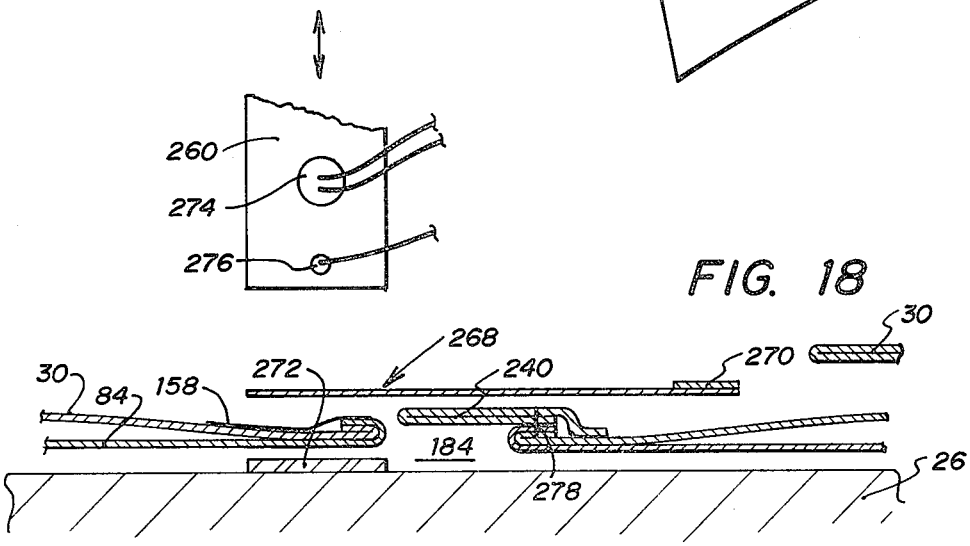
FIG. 18 is a cross-sectional view taken along line 18—18 of FIG. 17 in the direction of the arrows.

FIG. 18 shows further constructional details of station 22. For clarity, the plates of template 44 have been omitted from FIG. 18. The facing strip 268 is positioned over welt 240, the remainder of pocket slot 184, and the inside surface pocket bag 30. A block 272 is mounted on table 26 directly beneath bar 260. Block 272 is preferably constructed of a non-stick material, such as TEFLON. In the preferred construction of the invention, bar 260 is heated by an internal electrical resistance element 274. A thermocouple or thermistor 276 is attached to the bar 260 to monitor and control the temperature thereof. In the alternative, bar 260 could include an ultrasonic or radio frequency source, or an external source of radiation or heat could be utilized to activate the desired portion of adhesive strip 158. Actuation of cylinder 262 causes the head 260 to press the facing strip 268, pocket bag 30 and garment panel 84 against block 272. The facing strip 268 is thus adhesively connected to pocket bag 30 above pocket slot 184. Upon retraction of head 260, the template 44 is disengaged for advancement.

At this point in the operational sequence of apparatus 10, it will be apparent that the garment panel 84, pocket bag 30, welt 240 and facing strip 268 are all adhesively interconnected. Implantation of the pocket is nearly complete. If desired, the pocket bag 30 and garment panel 84 could now be removed from template 44 to permit closing and interconnection of pocket bag panels 32 and 34, and facing strip 268. A conventional steam press could be used for activating the remaining areas of adhesive in the pocket bag 30 to seal the pocket.

In some instances it may be desirable to add some stitching to the pocket bag 30 and garment panel 84 for purposes of reinforcement. The stitch 278, which is shown in FIG. 18, can be added adjacent to the pocket slot 184 to mechanically interconnect welt 240, pocket bag 30 and garment panel 84. A bar tack (not shown) can be provided adjacent to each end of the pocket slot 184 to mechanically interconnect the facing strip 268, welt 240, pocket bag 30 and garment panel 84. The addition of such stitching can be accomplished with a conventional sewing machines such as sewing machine 279 mounted on table 26 in FIG. 1.

Figure 19:
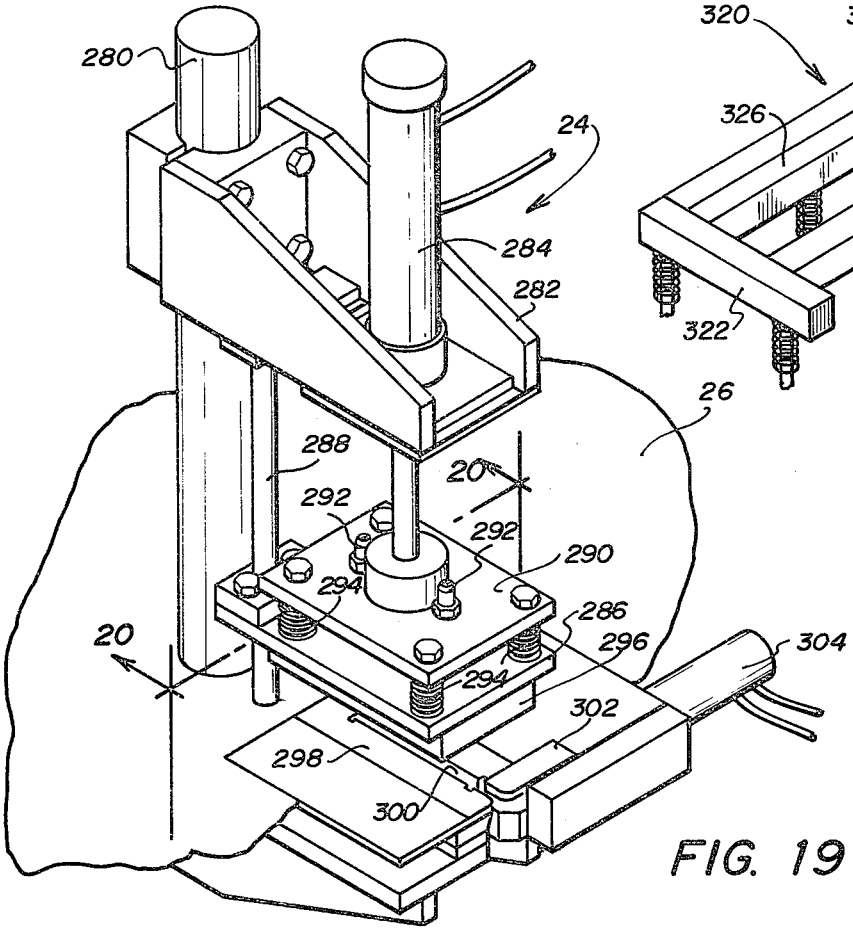
FIG. 19 is a perspective illustration of the last station in the invention.
Figure 20:
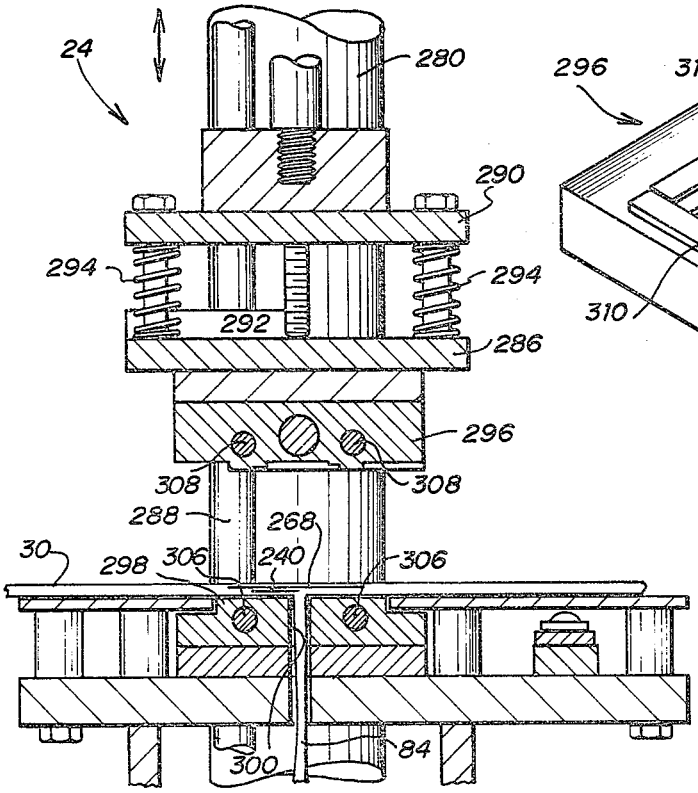
FIG. 20 is a cross-sectional view taken along line 20—20 of FIG. 19 in the direction of the arrows.

Referring to FIGS. 19 and 20, there are shown the constructional details of station 24. While a conventional steam press can be used to activate and adhesively seal the remaining portions of the pocket bag 30, the preferred embodiment of the invention includes station 24.

Station 24 includes a post 280 extending upwardly from table 26. A bracket 282 comprising a pair of spaced apart arms interconnected by a cross member is attached to post 280. A double-acting cylinder 284 is mounted on bracket 282. The cylinder 284 is preferably pneumatic. A cross member 286 is connected to the piston rod of cylinder 284. A guide rod 288 extending downwardly from bracket 282 is slidably received by cross member 286. A plate 290 is connected between cross member 286 and cylinder 274 by means of bolts 292 and springs 294. Cross member 286 is thus resiliently suspended beneath plate 290. Bolts 292 are adjustable to limit relative movement between cross member 286 and plate 290. A block 296 is supported by cross member 286. Cylinder 284 is thus operable to reciprocate block 296 relative to a platen 298 in the surface of table 26.

The platen 298 includes a slot 300 positioned beneath block 296. Slot 300 includes an open end, across which a gate 302 is slidable. Gate 302 is flush with platen 298. A double-acting cylinder 304 is coupled to gate 302. Cylinder 304 is preferably pneumatic Cylinder 304 is thus operable to close the end of slot 300 with gate 302.

Upon reaching station 24, template 44 is opened to permit removal of the interconnected pocket bag 30 and garment panel 84. FIG. 19 shows station 24 with slot 300 opened and ready to receive pocket bag 30 and garment panel 84, which have been omitted for clarity.

FIG. 20 illustrates station 24 after insertion of pocket bag 30 and garment panel 84 into slot 300. It will be observed that pocket bag 30 lies across platen 298 while garment panel 84 hangs downward through slot 300. After insertion of pocket bag 30 and garment panel 84, gate 302 is closed so that the area surrounding the pocket slot 184 is supported by the platen 298 and gate.

Actuation of cylinder 284 then causes block 296 to press the closed pocket bag 30 against platen 298. In accordance with the preferred construction, platen 298 is heated by means of internal electrical resistance elements 306 located adjacent slot 300. Similarly, block 296 is heated with internal electrical resistance elements 308, only two of which are shown in FIG. 20. Thermocouples or thermistors (not shown) are preferably attached to block 296 and platen 298 for monitoring and controlling the temperatures thereof. If desired, block 296 and platen 298 could include an ultrasonic or radio frequency source or an external source of radiation or heat could be utilized to activate and thus seal the remaining portions of adhesive within the folded pocket bag 30.

Figure 21:
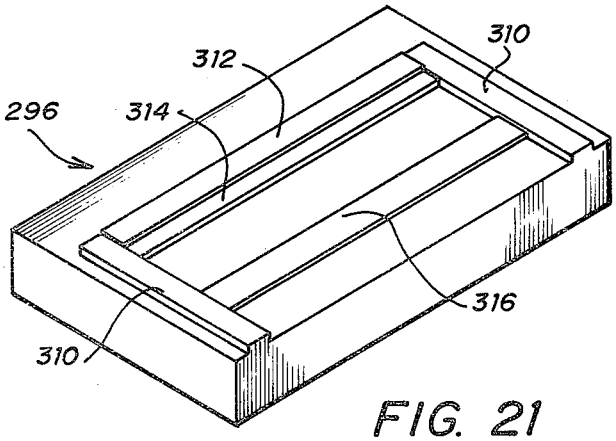
FIG. 21 is an enlarged perspective view of a portion of the station shown in FIG. 19.

FIG. 21 shows the preferred configuration of the face of block 296. The face of block 296 includes several ridges or raised surfaces. This configuration of block 296 facilitates the application of heat and pressure to particular areas of the pocket in order to obtain a good seal. Surfaces 310 are adapted to engage the longitudinal edges of pocket bag 30. Specifically, surfaces 310 engage adhesive strips 38 and 40 of pocket bag 30, which strips are shown in FIG. 2. Surface 312 is adapted to engage the top edge of adhesive strip 158 to adhesively connect the ends of pocket panels 32 and 34. Surface 314 is adapted to engage facing strip 268 between pocket panels 32 and 34 adjacent to the upper edge of pocket slot 184. Finally, surface 316 is for engagement with adhesive strip 270 to connect the outer pocket panel 34 with facing strip 268.

Those portions of adhesive which are activated between block 296 and platen 298 are thus caused to permeate the fabric materials and thereby effect permanent bonding. It will be seen that the pressure and heat is applied only to pocket bag 30 at station 24. Following retraction of block 296 and opening of gate 302, the garment panel 84 and the pocket implanted therein are removed from station 24 for subsequent assembly into a garment.

Figure 22:
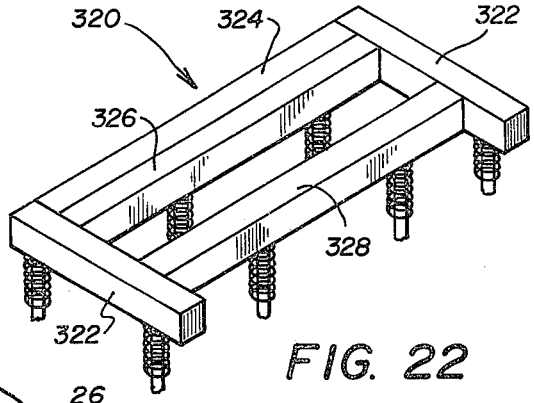
FIG. 22 is a perspective view of an alternative to the portion shown in FIG. 21.

FIG. 22 illustrates an alternative to block 296 in station 24. While block 296 is of one-piece construction in the preferred inventive embodiment, assembly 320 could be substituted therefor. Assembly 320 comprises five heads 322, 324, 326 and 328 each of which is independently heated and resiliently supported by springs from cross member 286. Heads 322, 324, 326 and 328 engage the same portions of pocket bag 30 as those engaged by surfaces 310, 312, 314 and 316, respectively, of block 296.

From the foregoing, it will be understood that the present invention comprises a pocket implantation apparatus having numerous advantages over the prior art. One important advantage of the invention involves elimination of numerous manual, time-consuming operations which were heretofore required in the integration of pockets into garment panels. Precut garment panels can be provided with pockets on a semi-automatic basis, resulting in time and cost savings in the overall process of garment fabrication. Other advantages of the invention will readily suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements and/or substitutions of parts or elements as fall within the spirit and scope of the invention.

We claim:

1. Apparatus for integrating a pocket bag into a garment panel to form a pocket, which comprises:

means for releasably holding the pocket bag and garment panel in predetermined relationship for transport together;

means for adhesively interconnecting the pocket bag and the garment panel;

means for forming a slit through the pocket bag and garment panel at the adhesive connection therebetween;

means for folding back and securing the edges of the slit to form a pocket slot through the pocket bag and garment panel; and means for securing a peripheral portion of the pocket bag to close the pocket.

2. The apparatus of claim 1, including:

means for positioning and securing a pocket welt to the pocket bag and over the pocket slot.

3. The apparatus of claim 1, including:

means for securing a facing strip to the pocket bag and over the pocket slot.

4. The apparatus of claim 1, including:

means for securing a welt to the pocket bag, said welt extending across a portion of the pocket slot; and means for securing a facing strip to the pocket bag in overlying relationship with the welt and the other portion of the pocket slot.

5. The apparatus of claim 1, wherein the means for connecting the pocket bag and garment panel comprises:

a strip of fusible adhesive material positioned between the pocket bag and garment panel;

means for selectively activating the adhesive strip; and means for selectively engaging the pocket bag, activated adhesive strip, and garment panel.

6. The apparatus of claim 1, wherein the means for forming a slit through the pocket bag and garment panel comprises:

an arrangement of cutting edges mounted for movement; and means for selectively effecting movement of said arrangement of cutting edges.

7. The apparatus of claim 1, wherein the means for folding back and securing the edges of the slit comprises:

at least one pair of pivotal folder arms mounted for movement relative to the slit;

means for selectively extending said arms through the slit;

means for selectively pivoting said arms outward to fold back opposite edges of the slit; and means for adhesively securing the folded back edges of the slit.

8. The apparatus of claim 1, wherein the means for securing a peripheral portion of the pocket bag comprises:

strips of fusible adhesive material positioned along peripheral portions of the pocket bag;

means for selectively activating the adhesive strips; and means for selectively engaging a peripheral portion of the pocket bag.

9. Apparatus for implanting a pocket bag with inner and outer pocket panels into a garment panel in order to form a pocket, comprising:

a moveable template for releasably holding the pocket bag and garment panel in closely adjacent relationship, said pocket bag being arranged with the inner pocket panel closest to said garment panel;

a strip of fusible adhesive material positioned between the inner pocket panel and garment panel;

means for selectively activating said adhesive strip and engaging the pocket bag and garment panel to form an adhesive connection therebetween;

means for forming a slit of predetermined configuration through the pocket bag and garment panel in the adhesive connection therebetween;

means for folding back and securing the edges of the slit to form a pocket slot extending through the pocket bag and garment panel; and means for securing the peripheries of the inner and outer pocket bag panels to close the pocket.

10. The apparatus of claim 9, including:

means for releasably positioning a welt adjacent to the pocket slot; and means for securing the welt to the pocket bag.

11. The apparatus of claim 9, including:

a facing strip positioned over the pocket slot; and means for securing the facing strip to the pocket bag.

12. The apparatus of claim 9, wherein the means for forming a slit through the pocket bag and garment panel comprises:

an arrangement of cutting edges mounted for movement relative to the template; and means for selectively effecting movement of said arrangement of cutting edges.

13. The apparatus of claim 9 wherein the means for folding back the edges of the slit comprises:

at least one pair of pivotal folder arms mounted for movement transverse to the slit;

means for selectively positioning said arms within the slit;

means for selectively pivoting said outward arms to fold back opposite edges of the slit; and means for adhesively securing the folded back edges of the slit.

14. The apparatus of claim 9, wherein the means for securing the peripheries of the pocket bag panels comprises:

strips of fusible adhesive material positioned along at least portions of the peripheries of the pocket bag panels; and means for selectively activating said adhesive strips and engaging the pocket bag panels to effect connection.

15. Apparatus for incorporating a prefabricated pocket bag into a garment panel to form a pocket, comprising:

means for adhesively interconnecting the pocket bag and garment panel;

means for providing a slit of predetermined configuration through the pocket bag and garment panel in the adhesive connection therebetween;

means for selectively folding back and securing the edges of the slit to form a pocket slot in the pocket bag and garment panel;

means for selectively positioning and securing a welt to the pocket bag along the pocket slot;

means for selectively securing a facing strip to the pocket bag over the welt; and means for selectively securing the periphery of the pocket bag to close the pocket.

* * * * *

UNITED STATES PATENT AND TRADEMARK OFFICE

CERTIFICATE OF CORRECTION

PATENT NO. : 4,315,793

DATED : February 16, 1982

INVENTOR(S) : Joseph W. A. Off et al

It is certified that error appears in the above—identified patent and that said Letters Patent is hereby corrected as shown below:

Column 7, line 51, "153" should be -- 158 --;

Column 7, line 59, "198" should be -- 190 --;

Column 8, line 39 "A" should be -- At --;

Signed and Sealed this

*Twenty-second* Day of *June 1982*

[SEAL]

*Attest:*

GERALD J. MOSSINGHOFF

*Attesting Officer*

*Commissioner of Patents and Trademarks*